US007841156B2

(12) United States Patent
Naroska et al.

(10) Patent No.: US 7,841,156 B2
(45) Date of Patent: Nov. 30, 2010

(54) METHOD AND DEVICE FOR SEALING A TEAR-OFF FOIL ONTO A PACKAGING ELEMENT

(76) Inventors: Marcus Naroska, Platanenstr. 7, Bad Salzuflen (DE) 32108; Rainer Naroska, Platanenstr. 7a, Bad Salzuflen (DE) 32108; Joachim Lachnitt, Am kleinen Kamp 23, Bad Salzuflen (DE) 32107

( * ) Notice: Subject to any disclaimer, the term of this patent is extended or adjusted under 35 U.S.C. 154(b) by 201 days.

(21) Appl. No.: 12/117,208

(22) Filed: May 8, 2008

(65) Prior Publication Data

US 2008/0276572 A1 Nov. 13, 2008

(30) Foreign Application Priority Data

May 11, 2007 (DE) ..... 10 2007 022 212

(51) Int. Cl.
*B65B 51/10* (2006.01)

(52) U.S. Cl. ..... 53/478; 53/287; 53/329.2

(58) Field of Classification Search ..... 53/476, 53/477, 478, 285, 287, 329.2, 329.5, 373.4, 53/373.8

See application file for complete search history.

(56) References Cited

U.S. PATENT DOCUMENTS 3,298,158 A * 1/1967 Schmidt ..... 53/329.5
3,874,145 A * 4/1975 Schmidt ..... 53/329.5
4,379,008 A * 4/1983 Gross et al. ..... 53/478
5,117,613 A * 6/1992 Pfaffmann ..... 53/478
5,345,747 A * 9/1994 Raque et al. ..... 53/478
5,379,572 A * 1/1995 Giovannone ..... 53/478
5,597,428 A * 1/1997 Matsumoto et al. ..... 53/478
5,606,847 A * 3/1997 Joensson et al. ..... 53/329.5
6,305,149 B1 * 10/2001 Gorlich et al. ..... 53/478
6,412,252 B1 * 7/2002 Sarles et al. ..... 53/329.2
6,834,476 B2 * 12/2004 Konishi ..... 53/329.5
7,269,932 B2 * 9/2007 Konishi ..... 53/329.5

* cited by examiner

*Primary Examiner*—Louis K Huynh
(74) *Attorney, Agent, or Firm*—Richard M. Goldberg

(57) ABSTRACT

Method for sealing a tear-off foil (16) onto a packaging element (12) including a sealing step in which the packaging element (12) is conveyed in a direction of transport (A) and, by a sealing stroke crosswise to the direction of transport (A), is moved towards a stamp tool (28) carrying punched-out foil (16), and is pressed against punched-out foil (16), with punched-out foil (16) and packaging element (12) being sealed together under the influence of heat, and in which the sealing step is preceded by a heating step in which packaging element (12) is heated by non-contact arrangement to at least the temperature required for subsequent sealing, and in that during the sealing step, stamp tool (28) carrying punched-out foil (16) is moved towards packaging element (12) by a feed stroke executed counter to the sealing stroke.

15 Claims, 4 Drawing Sheets

METHOD AND DEVICE FOR SEALING A TEAR-OFF FOIL ONTO A PACKAGING ELEMENT

BACKGROUND OF THE INVENTION

This invention relates to a method and device for sealing a tear-off foil onto a packaging element.

Many consumer products are now sold in packagings which are closed with a tear-off foil. For example, foods such as yoghurt or similar are largely sold in pots sealed with a foil made of aluminium, plastic or a composite material. The seal is normally executed with the aid of a stamp tool which presses the foil against the opening edge under the influence of heat, so that a meltable seal coating of the foil enters into a firmly bonded connection with the edge.

Alternatively, it is possible to start by sealing only part of the packaging with a foil in the above-described way, an intermediate ring, for example, and to then connect this part with the rest of the packaging by means of crimping or some other prior art method. Within the meaning of this description, then, the term packaging element is understood to designate both complete packagings such as pots or similar, or parts thereof.

The process of heating the connecting point between packaging element and foil has thus far usually been performed with the help of heating elements disposed in the stamp tool. The heating temperature has to be hot enough to melt the foil sealing layer, whilst at the same, damage from overheating is to be avoided. This applies to the foil in particular, the top of which may be varnished or printed or similar. Furthermore, the stamp tool is located in the immediate vicinity of machine parts which should not be exposed to heat, e.g. punching tools to punch the foil out of a web of foil. Thermal expansion in said tools has to be compensated by enlarging the cutting play. This in turn limits the choice of foil material. Whilst cost reasons often make it desirable to use foils with a low percentage of aluminium, low thickness and high tear strength, the use of such materials is problematic in this context. The deployment of cooling devices in adjacent machine and tool parts to prevent excessive heating increases the complexity of the method, however, leading to greater costs.

Furthermore, the question of heat expansion has to be borne in mind in relation to the geometry of the packaging element to be sealed. If prior art sealing tools are used, the packaging elements must have a flat sealing surface in the form of, for example, an inwardly pointing edge, which does not facilitate extraction of the goods inside the packaging.

Another problem is that the process speed is dictated by the duration of the sealing step, during which the packaging element has to be brought up to the necessary sealing temperature by the heated stamp tool. This imposes limits on the scope for increasing the output of prior art sealing machines, and hence of reducing production costs.

SUMMARY OF THE INVENTION

The task of this invention is, therefore, to create a sealing method for packaging elements of the above-mentioned type, which avoids the problems that occur when the sealing point between the packaging element and the foil is heated, such as, in particular, undesirable heating of machine parts and restrictions in the choice of foil material and geometry of the packaging element. Further, new opportunities for reducing process costs are to be created.

These tasks are solved according to the method and device according to the present invention.

In the method according to the invention, the sealing step, during which the foil is sealed onto the packaging element, is preceded by a heating step during which the packaging element is heated, using a non-contact technique, to a temperature sufficient for the subsequent sealing process. Hence there is no need at all for any heating elements in the stamp tool. As the packaging element has already attained the required temperature during the sealing step, contact times with the stamp tool can be substantially reduced, allowing an acceleration of the overall process. Thus the heating up and sealing processes are entirely disassociated in the method according to the invention. Rapid joining-up of the packaging element with the foil is ensured by a feed stroke of the stamp tool, by means of which the foil is brought towards the packaging element.

Further embodiments of the method according to the invention result from the sub-claims.

The device according to the invention for sealing a tear-off foil onto a packaging element is characterised in that a non-contact heating device is disposed upstream of the stamp tool in relation to the direction of transport of the packaging element within the sealing machine, so that the packaging element runs through the heating device and the sealing station one after the other. The conveyor device for transporting the packaging element comprises, besides the feed device for transferal between the machine stations, a lifting device which lifts the packaging element in the sealing station. The stamp tool can be lowered and moves the foil towards the packaging element. This transports the packaging element into its sealing position as fast as possible, so that it is largely prevented from cooling down on the way from the heating device to the sealing position.

BRIEF DESCRIPTION OF THE DRAWINGS

Other embodiments of the device according to the invention result from the sub-claims.

Preferred embodiments of the invention will be described in more detail below with reference to the enclosed drawings.

DETAILED DESCRIPTION

Figure 1:
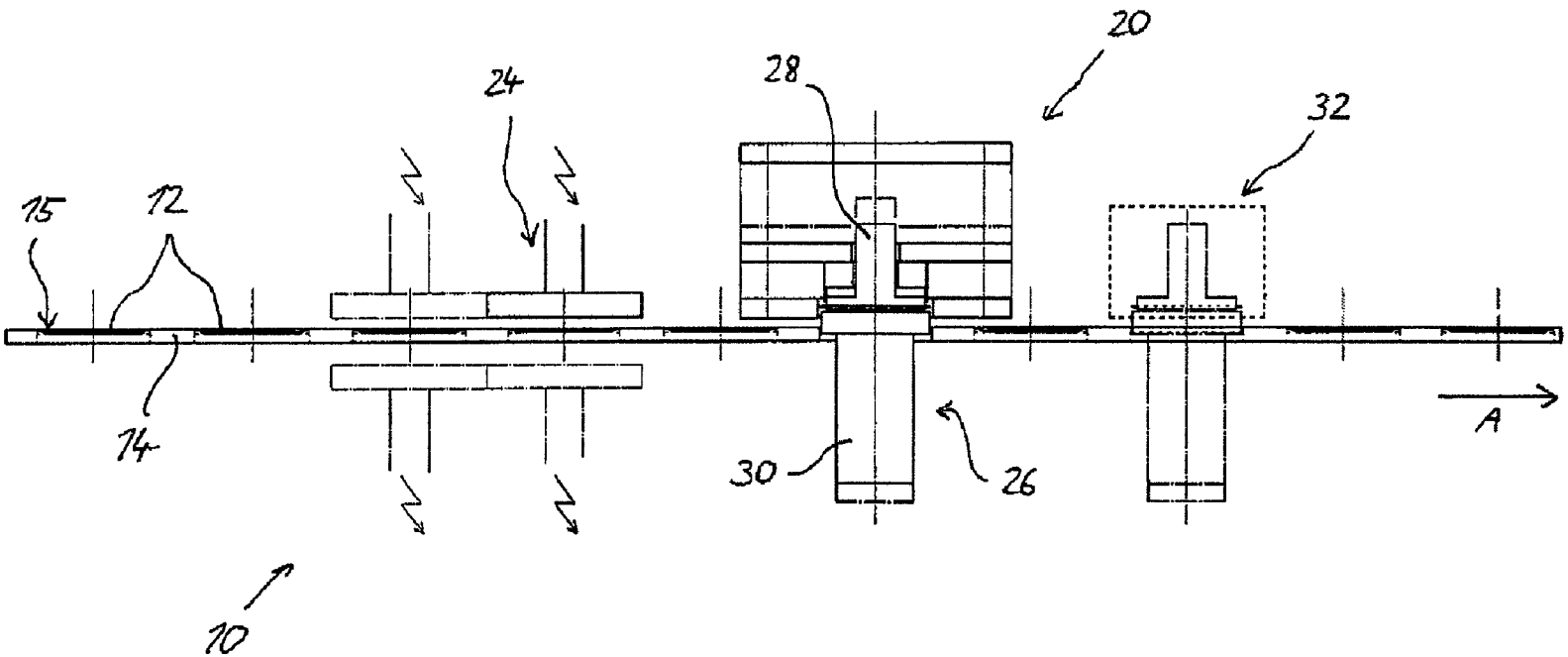
FIG. 1 is a diagrammatic side view of an embodiment of the device according to the invention for sealing a tear-off foil onto a packaging element.
Figure 2:
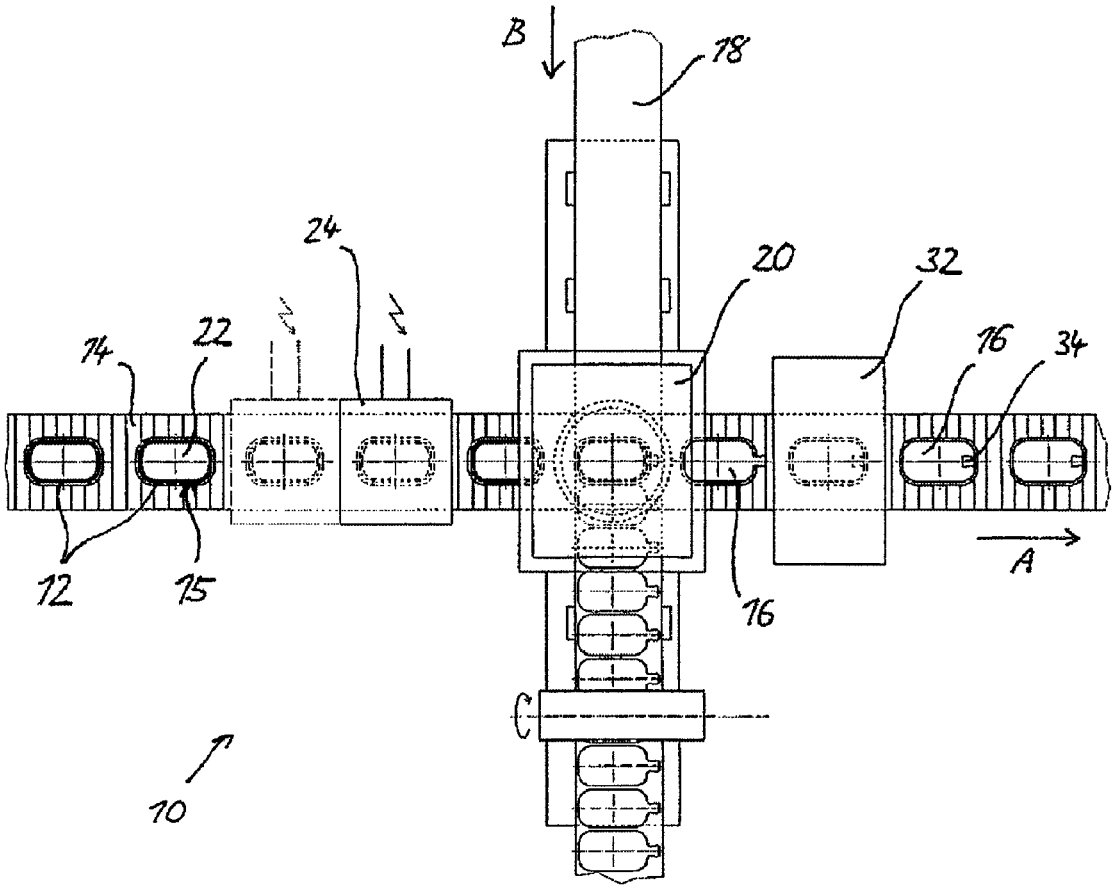
FIG. 2 is a top plan view of the device of FIG. 1.

The device 10 shown in FIGS. 1 and 2 serves to seal tear-off foils onto packaging elements 12, disposed consecutively in a conveyor belt 14 in the direction of transport A. For this purpose, conveyor belt 14 has open pockets 15, in which the packaging elements 12 rest. As can be seen from the top plan view in FIG. 2, the packaging elements 12 here have an approximately flat circular-oval shape with an opening 22. It is understood that this shape can essentially be chosen at will and may, for example, also be elliptical, circular or something similar. After the sealing process they can be joined to another packaging part, such as e.g. a pot, to form a complete packaging, for example by crimping or such like.

A foil web 18 is conveyed above conveyor belt 14 in a foil transport direction B, which, as seen in FIG. 2, is perpendicular to direction of transport A, but may also be at a differing angle to direction of transport A. Conveyor belt 14 and foil web 18 cross over at a sealing station 20, in which foil blanks 16 are punched out of foil web 18. One foil blank 16 and one packaging element 12 are pressed together and, under the effect of heat, enter into a firmly bonded connection with each other so that foil 16 tightly seals off opening 22 of packaging element 12.

This sealing step, in which the foil 16 and the packaging element 12 are joined together in sealing station 20, and which is described in the following FIGS. 3 to 6, is preceded by a heating step in which packaging element 12 is heated, using a non-contact technique, to a temperature at least sufficient to create the firmly bonded connection, thereby enabling thermal sealing. This heating step takes place in a heating device 24, disposed upstream of sealing station 20 in relation to the direction of transport A of packaging elements 12, and is passed through by conveyor belt 14. Heating device 24 can, for example, comprise an induction heating system which generates a magnetic field which a metallic packaging element 12 passes through. As this happens, an electric current flows inside packaging element 12, which heats up the material of the element. The amount of heat conducted to packaging element 12 during this process should be measured so that, in the subsequent sealing step in sealing station 20, the temperature is sufficient at the envisaged connecting point between packaging element 12 and foil 16. A regulating device may also be provided to regulate the quantity of heat supplied by heating device 24 in such a way that a predetermined temperature range is adhered to at the connecting point. The temperature to which packaging element 12 is heated during this process is advantageously higher than a minimum sealing temperature, as packaging element 12 may cool slightly on the way from heating device 24 into sealing station 20.

As shown in FIGS. 1 and 2 by phantom lines, the heating device 24 may be disposed above and/or below conveyor belt 14. It is also possible to use several heating devices 24 disposed consecutively in the direction of transport A of packaging elements 12. For non-contact heating, heat radiation or ultrasound are possible alternatives to induction heating, and heating device 24 may be envisaged to supplement this.

Sealing station 20 comprises a lifting device 26 which serves to lift a single packaging element 12 out of its pocket 15 in conveyor belt 14 in a sealing stroke, and to press it against a stamp tool 28 disposed above it, which carries the punched out foil 16 on its underside. In the example embodiment illustrated, lifting device 26 is formed by a stamp-shaped lower tool 30, which can be lifted vertically in the direction of conveyor belt 14 and lowered into a position in which its upper stamp surface is positioned underneath conveyor belt 14. This means that when lower tool 30 is in its lower position, conveyor belt 14 can pass freely through sealing station 20.

FIGS. 1 and 2 further show, disposed downstream of sealing station 20, a station 32 which, after sealing, serves to bend over a lateral tongue 34 of foil 16 onto the foil surface and to apply embossing, printing or similar to foil 16 or such like. This station 32 is not relevant to the mode of functioning of this invention.

In the detailed view in FIGS. 3 to 6, one can see the lower tool 30 of lifting device 26, the conveyor belt 14 with a partially shown packaging element 12, a stationary cutting ring 36 disposed directly above conveyor belt 14, foil web 18, with a foil blank 16 cut out of it, and stamp tool 28. Also shown is a cutting tool 38, whose periphery is provided with a downwardly oriented cutting edge 40, which encompasses the lateral edge of stamp tool 28. Cutting tool 38 can be displaced up and down together with stamp tool 28, but can also be moved up and down independently of stamp tool 28 in relation thereto.

Figure 3:
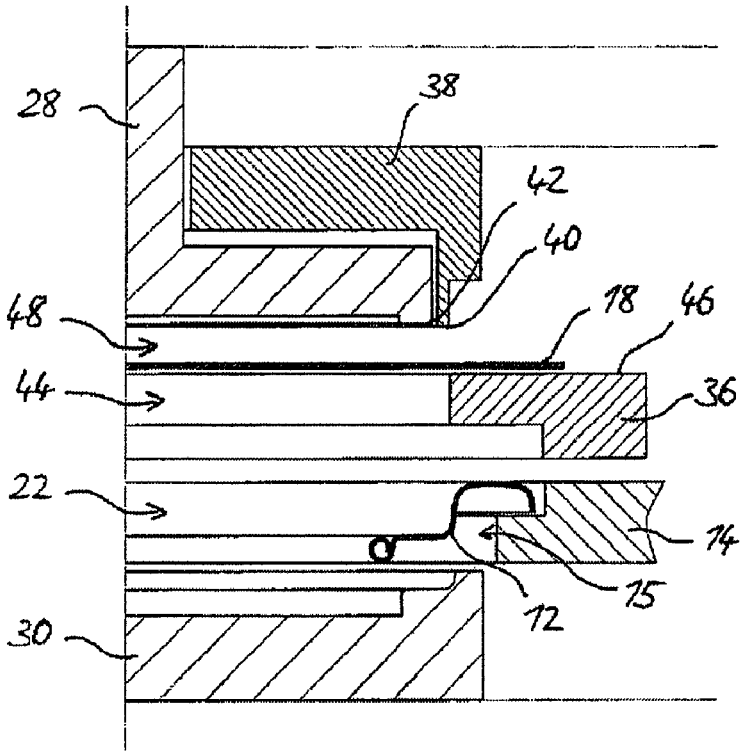
FIGS. 3 to 6 are detailed views of the device of FIG. 1 showing the sealing step of the sealing method according to the invention.
Figure 4:
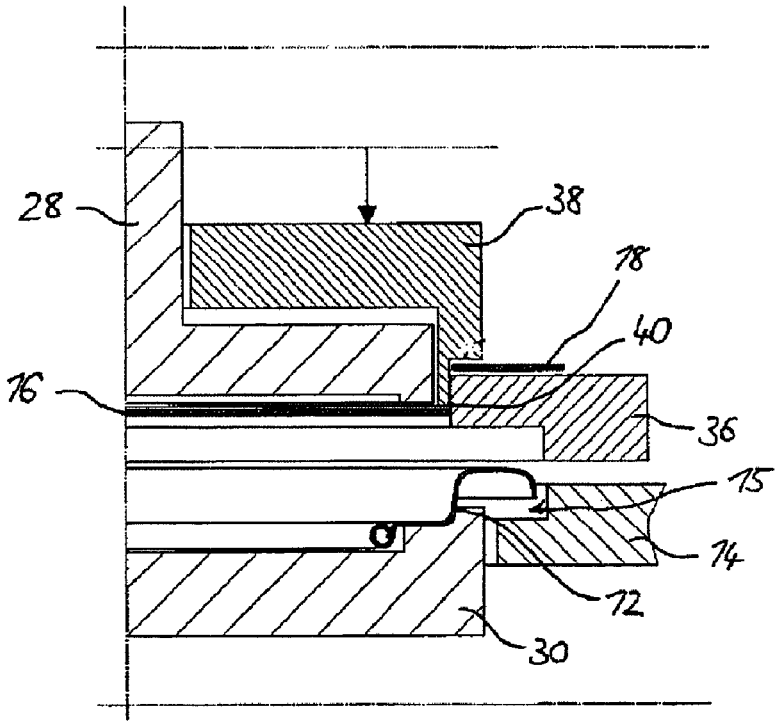

At the start of the sealing step in FIG. 3, the cutting tool 38 and stamp tool 28 are positioned at the top dead-centre position of their lift above an opening 44 in cutting ring 36, which, in relation to the movement of stamp tool 28 and cutting tool 38, is rigidly disposed in sealing station 20 in a frame. Between the top surface 46 of cutting ring 36 and the bottom of stamp tool 28, namely, the cutting edge 40 of cutting tool 38, there is a gap 48, which foil web 18 passes through. If stamp tool 28 and cutting tool 38 are lowered together, a foil 16 is punched out of foil web 18, as can be seen in FIG. 4. During the downward movement of stamp tool 28 and cutting tool 38, the latter penetrate into the opening 44 in cutting ring 36 and move the punched-out foil 16 downwards in the direction of packaging element 12, which is lifted out of its pocket 15 in conveyor belt 14 by the sealing stroke of lower tool 30 as the transition takes place from the position shown in FIG. 3 to that shown in FIG. 4.

Whilst the movement of cutting tool 38 comes to a stop after the cutting action, stamp tool 28 is moved further down than cutting tool 38, and brings the punched-out foil 16 further towards packaging element 12 in a feed stroke. By means of the downward feed stroke of stamp tool 28 towards the sealing stroke of packaging element 12, and by means of the sealing stroke itself, the sealing position shown in FIG. 5 is reached, in which lower tool 30 and stamp tool 28 are pressed vertically against each other, thereby pressing the packaging element 12, which is sandwiched between them, and foil 16, together.

The underside of foil 16 can be coated with a meltable material which, above a certain temperature, enters into a firmly bonded connection with packaging element 12, so that the inner edge of packaging element 12 is fully sealed by foil 16. Alternatively, packaging element 12 can be coated, by itself or in addition, with a meltable sealing material. To allow this thermal sealing to take place, packaging element 12 has previously been brought up to the required temperature by heating device 24, as described above. It is also possible that the foil material itself is meltable. As the required temperature has already been attained by the time the sealing position of FIG. 5 is reached, the contact time between lower tool 30 and stamp tool 28 can be kept brief, so that the cycle times of the device can be shortened overall. In the sequence of movements illustrated in FIGS. 3 to 6, it is not necessary to heat the connecting point between packaging element 12 and foil 16 during sealing, as is the case with the state of the art. This means there is no need for heating devices in stamp tool 28.

Figure 5:
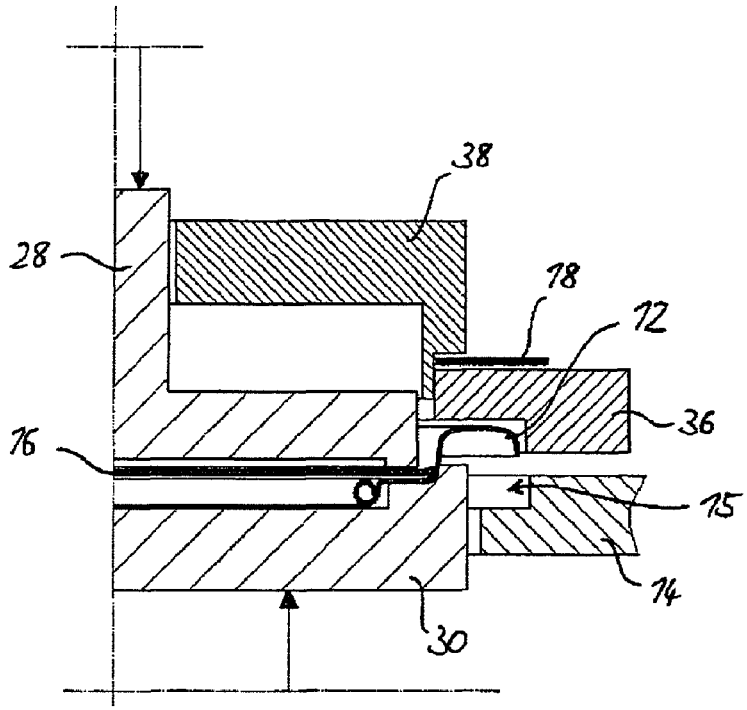
Figure 6:
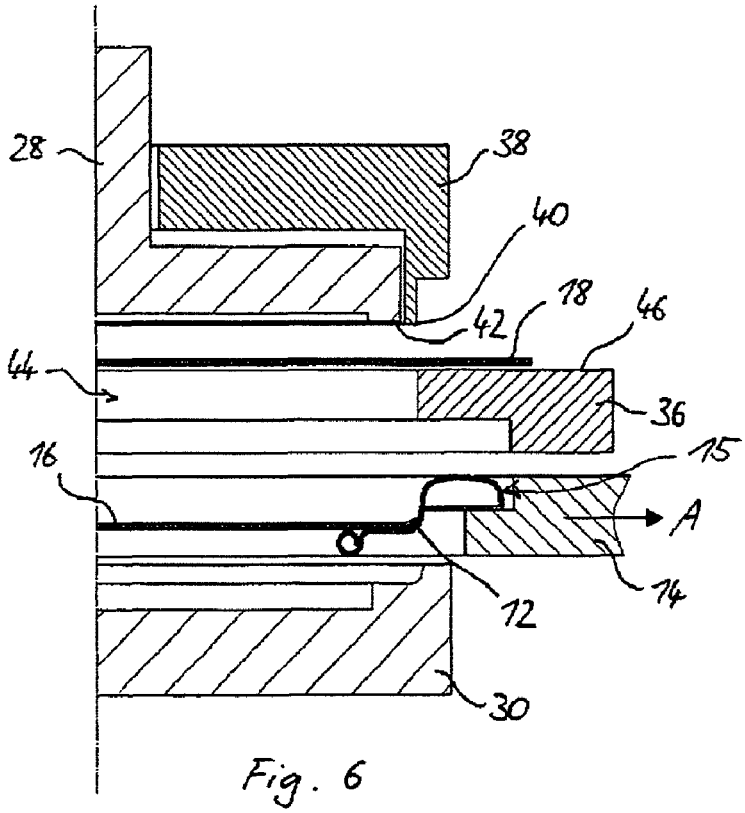

As stamp tool 28, which carries foil 16, is brought against the lifted packaging element 12 for sealing, packaging element 12 travels a shorter distance from the starting position in FIG. 3 to the sealing position in FIG. 5, than in devices in which packaging element 12 is pressed against foil 16 solely by a sealing stroke of packaging element 12, whilst stamp tool 28 has no drive of its own. Foil 16 and packaging element 12 are, in this case, moved simultaneously towards each other, to ensure the shortest possible paths for stamp tool 28 and lower tool 30. The related chronologically shortened sequence of movements involved in bringing together packaging element 12 and foil 16 inside sealing station 20 facilitates a corresponding shortening of the device cycle times.

As the stamp tool 28 does not have to be provided with a heating device, it can, in principle, by freely designed and, for example, made from any form-stable, temperature-resistant material. It may be an advantage to provide stamp tool 28, on its underside facing foil 16, with a contact element made from an elastic material, destined to rest against foil 16. For example, the outer edge 42 of the stamping surface of stamp tool 28 may be provided with an O-ring made from a non-metallic material such as rubber or plastic, which, in the sealing position of FIG. 5, elastically presses foil 16 onto packaging element 12. Furthermore, stamp tool 28 and lower tool 30 can be contrived in such a way that any heating they undergo during the sealing process is compensated for by the fact that it is possible to adhere closely to the temperature required for sealing, or to a corresponding temperature range.

Once the sealing step is complete, stamp tool 28 and cutting tool 38 are lifted again, so that they move back into the position shown in FIG. 3. Furthermore, lower tool 30 is lowered back down out of the position shown in FIG. 5, so that the packaging element 12 again rests in pocket 5 of conveyor belt 14, and is carried along by this latter. Foil web 18 is conveyed forward in its direction of transport B, so that a new section of web is available for a foil blank 16 to be punched out.

From this position, which is shown in FIG. 6, conveyor belt 14 can transport the sealed packaging element 12 onwards in the direction of transport A, until a new packaging element 12 for sealing moves into the position in FIG. 3, and the cycle shown in FIGS. 3 to 6 starts over again.

In the example embodiment shown here, packaging element 12 comprises only an oval-ring-shaped edge portion of the packaging, which, in a subsequent step of the method, is connected to a container by means of crimping or such like. It is also conceivable, however, that complete packagings rest in the pockets 15 of conveyor belt 14, whose upper edges are contrived similarly to the packaging element 12 depicted here, for sealing with foil 16.

The invention claimed is:

1. Method for sealing a tear-off foil onto a packaging element, comprising the following steps:

a sealing step including the steps of:

transporting the packaging element in a conveyor device, moving the packaging element by a sealing stroke crosswise to a direction of transport towards a stamp tool carrying punched-out foil, moving the stamp tool carrying punched-out foil towards the packaging element by a feed stroke executed counter to the sealing stroke, and pressing the packaging element during the crosswise sealing stroke against the foil to seal the foil and the packaging element together under the effect of heat, a heating step preceding the sealing step which includes the step of heating the packaging element by a non-contact arrangement, to at least a temperature required for subsequent sealing, and a joining step after the sealing step which includes the step of joining the packaging element to another packaging part to form a complete packaging.

2. The method of claim 1, wherein the heating step is effected by induction heating.

3. The method of claim 1, wherein the heating step is effected by thermal radiation.

4. The method according claim 1, wherein the heating step is effected by ultrasound.

5. The method according to claim 1, wherein the heating step supplies a quantity of heat to the packaging element which is regulated in such a way that during the sealing step, a predetermined temperature range is adhered to at a planned connecting point between the packaging element and the foil.

6. The method of claim 1, further comprising the step of punching out the foil of a foil web one of:

before the feed stroke, and during the feed stroke.

7. Device for sealing a tear-off foil onto a packaging element, comprising:

a conveyor device for conveying the packaging element in a direction of transport, a stamp tool for carrying punched-out foil, a lifting device for lifting and pressing the packaging element against the stamp tool carrying punched-out foil, a heating device for heating the packaging element, the heating device being disposed upstream of the stamp tool in relation to the direction of transport of the packaging element and is provided to heat up the packaging element in a non-contact manner, to at least a temperature required for subsequent sealing, and the stamp tool is adapted to be moved in a direction counter to a lifting direction of the packaging element.

8. The device of claim 7, wherein the heating device is an induction heating device.

9. The device of claim 7, wherein the heating device comprises a thermal radiator.

10. The device of claim 7, wherein the heating device is designed to generate ultrasound.

11. The device of claim 7, wherein the heating device comprises a regulating mechanism to adjust a quantity of heat to be supplied to the packaging element.

12. The device of claim 7, wherein the stamp tool is provided, on a side thereof facing the foil, with a contact element made from an elastic material intended to rest against the foil.

13. The device of claim 12, wherein the contact element comprises an O-ring made from a non-metallic material, which embraces an outside edge of a stamping surface of the stamp tool.

14. The device of claim 7, further comprising a cutting tool for punching out the foil from a foil web, which laterally encompasses the stamp tool and is displaceably disposed in a direction of movement of the stamp tool.

15. The device of claim 14, further comprising a cutting ring with an opening, which, relative to movement of the stamp tool and the cutting tool, is stationarily disposed in such a way that a cutting edge of the cutting tool, is positioned, when the cutting tool occupies an upper dead-centre position thereof, above the opening and passes through the opening when the cutting tool moves downwards.

* * * * *